US008970640B2

(12) United States Patent
Wang et al.

(10) Patent No.: US 8,970,640 B2
(45) Date of Patent: Mar. 3, 2015

(54) ELECTRONIC PAPER DISPLAY DRIVE METHOD AND APPARATUS THEREOF

(75) Inventors: Tzu-Ming Wang, Kaohsiung County (TW); Kai-Cheng Chuang, Tainan City (TW)

(73) Assignee: E Ink Holdings Inc., Hsinchu (TW)

( * ) Notice: Subject to any disclaimer, the term of this patent is extended or adjusted under 35 U.S.C. 154(b) by 934 days.

(21) Appl. No.: 13/032,650

(22) Filed: Feb. 23, 2011

(65) Prior Publication Data

US 2012/0062611 A1 Mar. 15, 2012

(30) Foreign Application Priority Data

Sep. 15, 2010 (TW) ..... 99131257 A

(51) Int. Cl.
*G09G 5/10* (2006.01)
*G09G 3/34* (2006.01)

(52) U.S. Cl.
CPC ..... *G09G 3/344* (2013.01); *G09G 2310/0251* (2013.01); *G09G 2320/0257* (2013.01); *G09G 2360/16* (2013.01)
USPC ..... 345/690

(58) Field of Classification Search
CPC combination set(s) only.
See application file for complete search history.

(56) References Cited

U.S. PATENT DOCUMENTS

| | | | | |
|---|---|---|---|---|
| 2007/0057905 | A1* | 3/2007 | Johnson et al. | 345/107 |
| 2007/0195027 | A1 | 8/2007 | Yang et al. | |
| 2009/0128478 | A1* | 5/2009 | Dembo | 345/98 |
| 2009/0267970 | A1 | 10/2009 | Wong et al. | |

FOREIGN PATENT DOCUMENTS

| | | | |
|---|---|---|---|
| CN | 1815314 | A | 8/2006 |
| CN | 101198961 | A | 6/2008 |
| CN | 101499238 | A | 8/2009 |
| CN | 101794553 | A | 8/2010 |
| TW | 200915258 | A | 4/2009 |
| TW | 201032206 | A1 | 9/2010 |

OTHER PUBLICATIONS

Office Action of Corresponding TW Application.
Office Action of Corresponding CN Application.

* cited by examiner

*Primary Examiner* — Tony N Ngo
(74) *Attorney, Agent, or Firm* — CKC & Partners Co., Ltd.

(57) ABSTRACT

The present invention provides a drive method for an electronic paper display. The method comprises to display a present image. Then, color data of pixels of the present image is gathered. The color data is compared to select one of a first color and a second color to be as a main color. Finally, a refresh image is displayed in the electronic paper display following the present image based on the main color.

16 Claims, 3 Drawing Sheets

ELECTRONIC PAPER DISPLAY DRIVE METHOD AND APPARATUS THEREOF

RELATED APPLICATIONS

This application claims priority to Taiwan Application Serial Number 099131257, filed Sep. 15, 2010, which is herein incorporated by reference.

FIELD OF INVENTION

The present invention relates to a drive method and apparatus thereof. More particularly, the present invention relates to a drive method and apparatus thereof for an Electronic Paper display.

DESCRIPTION OF RELATED ART

Regarding the developing of display technology, novel displays have been used in portable computer, mobile phone, digital camera and other electronic products. Among those displays, electronic paper display, liquid crystal display (LCD) and organic light-emitting display (OLED) are the most potential displays.

The development of electronic paper displays began in the 1970s. The electronic paper display comprises many charged balls. One side of each ball is white and the other side is black. When the electric field in the electronic paper display is altered, the balls rotate and then different colors can be displayed. The second generation of electronic paper displays started in the 1990s. In this generation, microcapsules replace traditional balls. The microcapsules are filled with insulation oil and a plurality of white charged particles and black charged particles. By altering the external electric field, the particles move toward different directions. When the white particles move upward, the microcapsules display white color. When the black particles move upward, the microcapsules display black color.

Typically, the display method of the electronic paper display is to display the first image, then, the second image is instant displayed following the first image. However, the sticky insulation oil filled in the microcapsules limited the movement velocity of the white particles and the black particles. That is, when the display is switched to display the second image, a ghost image of the first image is displayed in the display. The ghost image reduces the display quality.

Therefore, a method and apparatus that can improve the display quality is needed.

SUMMARY

One purpose of the present invention is to provide a display method. The color data of pixels for displaying a present image is compared to determine a main color of the present image. According to the main color, a color of a compensation image is determined. The compensation image is displayed in the display following the present image.

One purpose of the present invention is to provide a display apparatus. The apparatus compares the color data of pixels for displaying a present image to determine a main color of the present image. Then, a color of a compensation image is determined according to the main color. The compensation image is displayed in the display following the present image.

The present invention provides a drive method for an electronic paper display. The method comprises to display a present image. Then, color data of pixels of the present image is gathered. The color data is compared to select one of a first color and a second color to be as a main color. Finally, a refresh image is displayed in the electronic paper display following the present image based on the main color.

In an embodiment, the first color is a white color and the second color is a black color. The step of comparing the color data to select one of a first color and a second color to be as a main color further comprises to compare a number of electrodes receiving positive voltage value with a number of electrodes receiving negative voltage value in a substrate of the electronic paper display. When the number of electrodes receiving positive voltage value is larger than the number of electrodes receiving negative voltage value, the second color is selected as the main color. When the number of electrodes receiving positive voltage value is less than the number of electrodes receiving negative voltage value, the first color is selected as the main color.

In an embodiment, the first color is a white color and the second color is a black color. The step of comparing the color data to select one of a first color and a second color to be as a main color further comprises to set a gray level threshold value. The gray level value of each pixel is compared with the gray level threshold value a number of pixels having gray level values less than the gray level threshold value is compared with a number of pixels having gray level values larger than the gray level threshold value. When the number of pixels having gray level values less than the gray level threshold value is larger than the number of pixels having gray level values larger than the gray level threshold value, the second color is selected as the main color. When the number of pixels having gray level values less than the gray level threshold value is less than the number of pixels having gray level values larger than the gray level threshold value, the first color is selected as the main color.

In an embodiment, when the main color is the first color, the step of displaying a refresh image based on the main color further comprises to display the first color in the electronic paper display and, then, to display the second color in the electronic paper display.

In an embodiment, when the main color is the second color, the step of displaying a refresh image based on the main color further comprises to display the second color in the electronic paper display and, then, to display the first color in the electronic paper display.

In an embodiment, when the main color is the first color, the step of displaying a refresh image based on the main color further comprises to display the first color in the electronic paper display.

In an embodiment, when the main color is the second color, the step of displaying a refresh image based on the main color further comprises to display the second color in the electronic paper display.

The present invention provides a drive apparatus for driving an electronic paper display. The apparatus includes a memory unit for storing color data of pixels of images; a drive unit for displaying a present image in the electronic paper display; a calculating unit for gathering color data of pixels of the present image and comparing the color data to select one of a first color and a second color to be as a main color; and an initialing unit for controlling the drive unit to display a refresh image based on the main color following the present image.

In an embodiment, the first color is a white color and the second color is a black color. The calculating unit further compares a number of electrodes receiving positive voltage value with a number of electrodes receiving negative voltage value in a substrate of the electronic paper display. When the number of electrodes receiving positive voltage value is larger than the number of electrodes receiving negative voltage value, the calculating unit selects the second color as the main color. When the number of electrodes receiving to positive voltage value is less than the number of electrodes receiving negative voltage value, the calculating unit selects the first color as the main color.

In an embodiment, the first color is a white color and the second color is a black color. The calculating unit further sets a gray level threshold value to compare a gray level value of each pixel with the gray level threshold value and compare a number of pixels having gray level values less than the gray level threshold value with a number of pixels having gray level values larger than the gray level threshold value. When the number of pixels having gray level values less than the gray level threshold value is larger than the number of pixels having gray level values larger than the gray level threshold value, the calculating unit selects the second color as the main color. When the number of pixels having gray level values less than the gray level threshold value is less than the number of pixels having gray level values larger than the gray level threshold value, the calculating unit selects the first color as the main color.

In an embodiment, when the main color is the first color, the initialing unit controls the drive unit to display the first color in the electronic paper display and, then, to display the second color in the electronic paper display.

In an embodiment, when the main color is the second color, the initialing unit controls the drive unit to display the second color in the electronic paper display and, then, to display the first color in the electronic paper display.

In an embodiment, when the main color is the second color, the initialing unit controls the drive unit to display the second color in the electronic paper display.

In an embodiment, when the main color is the first color, the initialing unit controls the drive unit to display the first color in the electronic paper display.

Accordingly, the color of the refresh image is related to the main color of the present image. For example, when the first color is selected as the main color of the present image, after the present image is displayed, the first color data is transmitted to all pixels to display. Because the number of pixels having the main color of first color is larger than the number of pixels having the main color of second color, that is, the number of pixels needed to change to display first color is less than the number of pixels not needed to change to display first color, the switch velocity from the present image to the fresh image is improved and the power consumption is also reduced.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
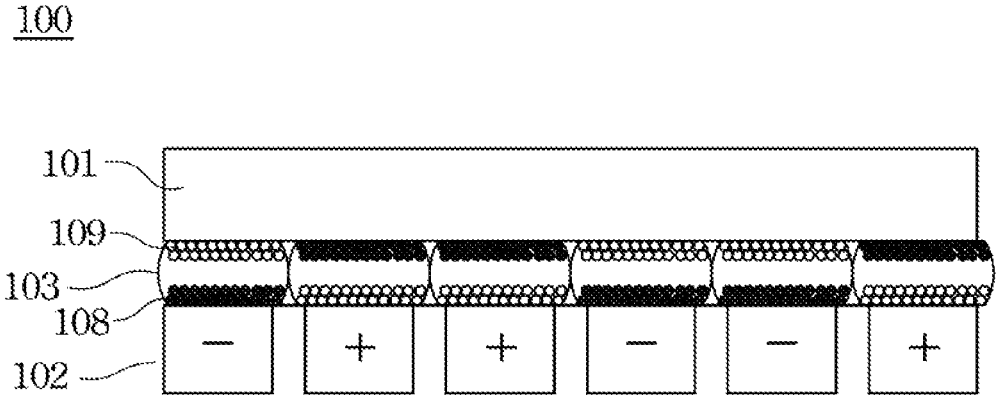
FIG. 1 illustrates a schematic diagram of an electronic paper display.

FIG. 1 illustrates a schematic diagram of an electronic paper display. The electronic paper display 100 includes two glass substrates 101 and 102 to and an electronic ink layer 103 located between the two glass substrates 101 and 102. A common electrode is formed over the glass substrate 101. A plurality of electrode is formed in the glass substrate 102. The glass substrates 101 and 102 can be replaced by plastic substrates. The electronic ink layer 103 includes a plurality of microcapsules whose diameter is about 50 micrometer to 70 micrometer. Each microcapsules includes black particles 108 and white particles 109. When the electrodes in the glass substrate 102 are charged, the charged electrodes can move up or down the black particles 108 and white particles 109 to display a black-white image in the visual side 106. For example, the black particles 108 are positive electrical charged and the white particles 109 are negative electrical charged. When an electrode in the glass substrate 102 is charged to form a negative electrode, the positive electrical charged black particles 108 are absorbed and the negative electrical charged white particles 109 are repulse. That is, the white particles 109 are arranged in the visual side 106 to display white color.

Figure 2:
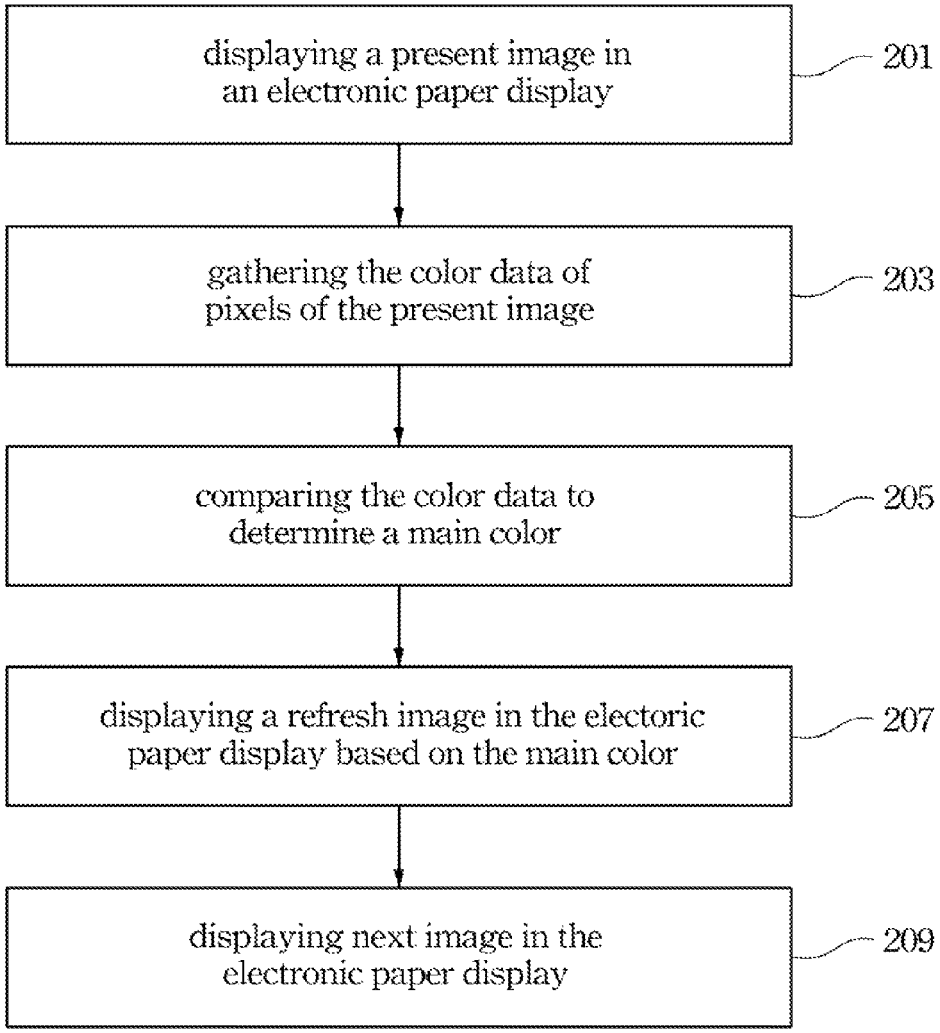
FIG. 2 illustrates a flow chart to drive the electronic paper display according to an embodiment of the present invention.

FIG. 2 illustrates a flow chart to drive the electronic paper display according to an embodiment of the present invention. First, in step 201, a present image is displayed in an electronic paper display. It is noticed that the method of the present invention can be used to drive the electronic paper display to display a colorful image or a black-white image.

In step 203, the color data transmitted to the pixels to display the present image is gathered. In an embodiment, the color data is the gray level value transmitted to each pixel. Accordingly, the gray level value of each pixel is gathered in this step. In another embodiment, the color data is the voltage value to applied to each pixel. Accordingly, the voltage value applied to each pixel is gathered in this step.

Next, in step 205, the color data transmitted to the pixels are compared with a threshold value to select one of the first color and the second color as the main color of the present image. In an embodiment, the main color of the present image is determined by comparing the gray level of pixels. The Gray level is a shade of gray assigned to a pixel. The shades are usually positive integer values taken from the gray-scale. A gray level can have a value from 0 (black) to 255 (white). Therefore, the first color is white color and the second color is black color. The color data is the gray level value of each pixel and the threshold value is a gray level threshold value of 125. Accordingly, the gray level value of each pixel is compared with the gray level threshold value, 125, to determine the main color of this pixel. For example, when the gray level value of a pixel is larger than the gray level threshold value, this pixel is set to have a main color of first color. When the gray level value of a pixel is less than the gray level threshold value, this pixel is set to have a main color of second color. After all pixels are compared with the gray level threshold value, the number of pixels having the main color of first color and the number of pixels having the main color of second color are counted to determine the number of pixels having the main color of first color is larger or less than the number of pixels having the main color of second color. When the number of pixels having the main color of first color is larger than the number of pixels having the main color of second color, the first color is selected as the main color of the present image. When the number of pixels having the main color of first color is less than the number of pixels having the main color of second color, the second color is selected as the main color of the present image.

In another embodiment, the main color of the present image is determined by comparing the number of electrodes receiving positive voltage value with the number of electrodes receiving negative voltage value in glass substrate 102. For example, the black particles 108 are positive electrical charged and the white particles 109 are negative electrical charged. Accordingly, when the number of electrodes receiving positive voltage value is larger than the number of electrodes receiving negative voltage value in glass substrate 102, the more number of the positive electrical charged black particles 108 are arranged in the visual side 106. Therefore, the black color is selected as the main color of the present image. On the other hand, when the number of electrodes receiving positive voltage value is less than the number of electrodes receiving negative voltage value in glass substrate 102, the more number of the negative electrical charged white particles 109 are arranged in the visual side 106. Therefore, the white color is selected as the main color of the present image.

Next, in step 207, a refresh image is displayed in the electronic paper display. Finally, in step 209, a next image is displayed in the electronic paper display. For example, when the first color is selected as the main color of the present image in step 205, a refresh image having the first color is displayed in the electronic paper display following the present image. Then, the next image is displayed in the electronic paper display following the refresh image. On the other hand, when the second color is selected as the main color of the present image is step 205, a refresh image having the second color is displayed in the electronic paper display following the present image. Then, the next image is displayed in the electronic paper display following the refresh image. By displaying a refresh image after the present image, the same color data is transmitted to all pixels and same voltage value is applied to the electrodes in glass substrate 102. Then, the next image is displayed following the refresh image. Therefore, the ghost image of the present image is removed while the next image is displayed.

According to the present invention, the color of the refresh image is related to the main color of the present image. For example, when the number of pixels having the main color of first color is larger than the number of pixels having the main color of second color, the first color is selected as the main color of the present image. Therefore, the color of the refresh image is the first color. That is, after the present image is displayed, the first color data is transmitted to all pixels to display. Because the number of pixels having the main color of first color is larger than the number of pixels having the main color of second color, that is, the number of pixels needed to change to display first color is less, the switch velocity from the present image to the fresh image is improved and the power consumption is also reduced.

Moreover, in another embodiment, the refresh image includes two continuously images with different colors. For example, when the number of pixels having the main color of first color is larger than the number of pixels having the main color of second color, the first color is selected as the main color of the present image. Accordingly, when the refresh image is displayed in the display following the present image, the first color is first displayed in the display, then, the second color is displayed in the display. In other words, during displaying the refresh image, two different colors are continuously displayed. On the other hand, when the number of pixels having the main color of second color is larger than the number of pixels having the main color of first color, the second color is selected as the main color of the present image. Accordingly, when the refresh image is displayed in the display following the present image, the second color is first displayed in the display, then, the first color is displayed in the display. In other words, during displaying the refresh image, two different colors are continuously displayed.

Figure 3:
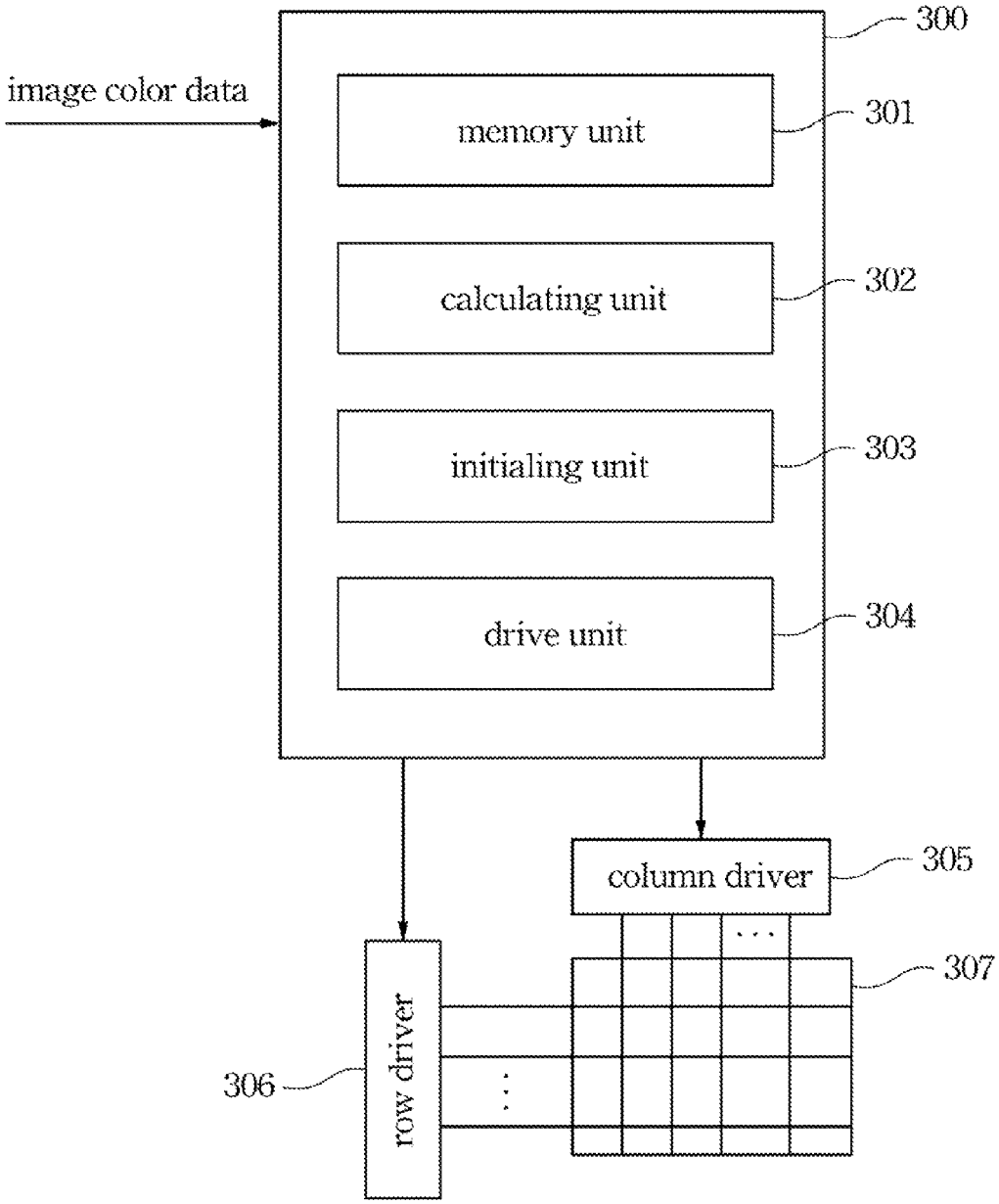
FIG. 3 is a schematic diagram of a driver to drive the electronic paper display according to an embodiment of the present invention.

FIG. 3 is a schematic diagram of a driver to drive the electronic paper display according to an embodiment of the present invention. The drive apparatus 300 includes a memory unit 301, a calculating unit 302, an initialing unit 303 and a drive unit 304.

The memory unit 301 receives and stores the color data of images.

The drive unit 304, based on the color data stored in the memory unit 301, controls a column driver 305 and a row driver 306 to display images in the electronic paper display.

The calculating unit 302 gathers the color data transmitted by the drive unit 304 to the pixels to display the present image. In an embodiment, the color data is the gray level value of each pixel. Accordingly, the calculating unit 302 compare the gray level value of each pixel with the gray level threshold value to select one of the first color and the second color as the main color of the present image. For example, when the gray level value of a pixel is larger than the gray level threshold value, this pixel is set to have a main color of first color. When the gray level value of a pixel is less than the gray level threshold value, this pixel is set to have a main color of second color. After all pixels are compared with the gray level threshold value, the number of pixels having the main color of first color is compared with the number of pixels having the main color of second color to determine the main color. In another embodiment, the calculating unit 302 can calculate the number of electrodes receiving positive voltage value and the number of electrodes receiving negative voltage value in glass substrate 102 to determine the main color.

The initialing unit 303 display a refresh image in the electronic paper display based on the calculating result of the calculating unit 302. For example, when the first color is selected as the main color of the present by the image calculating unit 302, the initialing unit 303 controls the drive unit 304 to display a refresh image having the first color in the electronic paper display following the present image. On the other hand, when the second color is selected as the main color of the present image by the image calculating unit 302, the initialing unit 303 controls the drive unit 304 to display a refresh image having the second color in the electronic paper display following the present image.

Moreover, in another embodiment, the initialing unit 303 can drive the drive unit 304 to continuously display two images with different colors to form the refresh image. For example, when the number of pixels having the main color of first color is larger than the number of pixels having the main color of second color, the first color is selected as the main color of the present image. Accordingly, the initialing unit 303 controls the drive unit 304 to display the first color first, then, to display the second color to form the refresh image. On the other hand, when the number of pixels having the main color of second color is larger than the number of pixels having the main color of first color, the second color is selected as the main color of the present image. Accordingly, the initialing unit 303 controls the drive unit 304 to display the second color first, then, to display the first color to form the refresh mage.

Accordingly, in this embodiment, during displaying the refresh image, two different colors are continuously displayed. However, the color displayed first is the main color of the present image. For example, when the number of pixels having the main color of first color is larger than the number of pixels having the main color of second color, after the present image is displayed, the first color is displayed first, then, the second color is displayed. Because the number of pixels having the main color of first color is larger than the number of pixels having the main color of second color, that is, the number of pixels needed to change to display first color is less than the number of pixels not needed to change to display first color, the switch velocity from the present image to the fresh image is improved and the power consumption is also reduced.

Although the present invention has been described in considerable detail with reference to certain embodiments thereof, other embodiments are possible. Therefore, it will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A drive method for driving an electronic paper display, the method comprising:

displaying a present image;

gathering color data of pixels of the present image;

comparing the color data of the pixels of the present image to determine main colors of the pixels of the present image, wherein each of the main colors of the pixels of the present image is determined as one of a first color and a second color;

selecting one of the first color and the second color to be as a main color of the present image according to whether the number of the pixels with the main colors of the first colors is greater than the number of the pixels with main color of the second colors; and displaying a refresh image based on the fact that the main color of the present image is the first color or the second color following the present image.

2. The drive method of claim 1, wherein the first color is a white color and the second color is a black color.

3. The drive method of claim 2, wherein the step of comparing the color data of the pixels of the present image to determine main colors of the pixels of the present image further comprises:

comparing a number of electrodes receiving positive voltage value with a number of electrodes receiving negative voltage value in a substrate of the electronic paper display;

wherein when the number of electrodes receiving positive voltage value is larger than the number of electrodes receiving negative voltage value, the second color is selected as the main color;

wherein when the number of electrodes receiving positive voltage value is less than the number of electrodes receiving negative voltage value, the first color is selected as the main color.

4. The drive method of claim 2, wherein the step of comparing the color data of the pixels of the present image to determine main colors of the pixels of the present image further comprises:

setting a gray level threshold value;

comparing a gray level value of each pixel with the gray level threshold value; and comparing a number of pixels having gray level values less than the gray level threshold value with a number of pixels having gray level values larger than the gray level threshold value;

wherein when the number of pixels having gray level values less than the gray level threshold value is larger than the number of pixels having gray level values larger than the gray level threshold value, the second color is selected as the main color;

wherein when the number of pixels having gray level values less than the gray level threshold value is less than the number of pixels having gray level values larger than the gray level threshold value, the first color is selected as the main color.

5. The drive method of claim 1, wherein when the main color is the first color, the step of displaying a refresh image based on the main color further comprises to display the first color in the electronic paper display and, then, to display the second color in the electronic paper display.

6. The drive method of claim 1, wherein when the main color is the second color, the step of displaying a refresh image based on the main color further comprises to display the second color in the electronic paper display and, then, to display the first color in the electronic paper display.

7. The drive method of claim 1, wherein when the main color is the first color, the step of displaying a refresh image based on the main color further comprises to display the first color in the electronic paper display.

8. The drive method of claim 1, wherein when the main color is the second color, the step of displaying a refresh image based on the main color further comprises to display the second color in the electronic paper display.

9. A drive apparatus for driving an electronic paper display, the apparatus comprising:

a memory unit for storing color data of pixels of images; and a driving circuit configured to:

drive the electronic paper display for displaying a present image in the electronic paper display;

gather color data of pixels of the present image and comparing the color data of the pixels of the present image to select one of a first color and a second color to be as a main color of the present image;

compare the color data of the pixels of the present image to determine main colors of the pixels of the present image, wherein each of the main colors of the pixels of the present image is determined as one of a first color and a second color;

select one of the first color and a second color to be as a main color of the present image according to whether the number of the pixels with the main colors of the first colors is greater than the number of the pixels with main color of the second colors; and drive the electronic paper display for displaying a refresh image in the electronic paper display based on the fact that the main color of the present image is the first color or the second color following the present image.

10. The drive apparatus of claim 9, wherein the first color is a white color and the second color is a black color.

11. The drive apparatus of claim 10, wherein the driving circuit further compares a number of electrodes receiving positive voltage value with a number of electrodes receiving negative voltage value in a substrate of the electronic paper display, wherein when the number of electrodes receiving positive voltage value is larger than the number of electrodes receiving negative voltage value, the driving circuit selects the second color as the main color, and wherein when the number of electrodes receiving positive voltage value is less than the number of electrodes receiving negative voltage value, the driving circuit selects the first color as the main color.

12. The drive apparatus of claim 10, wherein the driving circuit further sets a gray level threshold value to compare a gray level value of each pixel with the gray level threshold value and compare a number of pixels having gray level values less than the gray level threshold value with a number of pixels having gray level values larger than the gray level threshold value;

wherein when the number of pixels having gray level values less than the gray level threshold value is larger than the number of pixels having gray level values larger than the gray level threshold value, the driving circuit selects the second color as the main color;

wherein when the number of pixels having gray level values less than the gray level threshold value is less than the number of pixels having gray level values larger than the gray level threshold value, the driving circuit selects the first color as the main color.

13. The drive apparatus of claim 9, wherein when the main color is the first color, the driving circuit displays the first color, in the electronic paper display and, then, to display the second color in the electronic paper display.

14. The drive apparatus of claim 9, wherein when the main color is the second color, the driving circuit displays the second color in the electronic paper display and, then, to display the first color in the electronic paper display.

15. The drive apparatus of claim 9, wherein when the main color is the second color, the driving circuit displays the second color in the electronic paper display.

16. The drive apparatus of claim 9, wherein when the main color is the first color, the driving circuit displays the first color in the electronic paper display.

* * * * *